US007611023B2

(12) United States Patent
Ito

(10) Patent No.: US 7,611,023 B2
(45) Date of Patent: Nov. 3, 2009

(54) OVERHEAD TRAVELLING CARRIAGE

(75) Inventor: Yasuhisa Ito, Aichi (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 1193 days.

(21) Appl. No.: 10/303,735

(22) Filed: Nov. 26, 2002

(65) Prior Publication Data

US 2003/0127410 A1 Jul. 10, 2003

(30) Foreign Application Priority Data

Nov. 30, 2001 (JP) ..... 2001-366239

(51) Int. Cl.
*B66C 11/12* (2006.01)

(52) U.S. Cl. ..... 212/332; 414/940

(58) Field of Classification Search ..... 212/273, 212/100–105, 146, 147, 332; 294/902; 414/940
See application file for complete search history.

(56) References Cited

U.S. PATENT DOCUMENTS

| | | | | | |
|---|---|---|---|---|---|
| 390,560 | A | * | 10/1888 | Brown | 212/95 |
| 609,615 | A | * | 8/1898 | Fuller | 212/105 |
| 1,278,891 | A | * | 9/1918 | Ennis | 212/225 |
| 1,446,724 | A | * | 2/1923 | Reilly | 212/105 |
| 1,922,176 | A | * | 8/1933 | Ruhland | 212/93 |
| 3,794,185 | A | * | 2/1974 | Kroll et al. | 254/399 |
| 4,431,359 | A | * | 2/1984 | Toniolo | 414/139.9 |
| 4,736,971 | A | * | 4/1988 | McManus | 294/87.1 |
| 5,478,181 | A | * | 12/1995 | Rudolf et al. | 414/140.3 |
| 6,183,184 | B1 | * | 2/2001 | Shiwaku | 414/281 |

FOREIGN PATENT DOCUMENTS

| | | | | |
|---|---|---|---|---|
| JP | S59-46978 | | 3/1984 | |
| JP | 7-252086 | | 10/1995 | |
| JP | 9-77455 | | 3/1997 | |
| JP | 2907077 | | 4/1999 | |
| SU | 502830 | * | 2/1976 | 212/273 |

OTHER PUBLICATIONS

Machine translation by the PAJ web page of Japanese Publication 09077455 A, the Shiaku reference.*
Opposition issued Jul. 6, 2004 by Japanese Patent Office.

* cited by examiner

*Primary Examiner*—Thomas J. Brahan
(74) *Attorney, Agent, or Firm*—Westman, Hattori, Daniels & Adrian, LLP

(57) ABSTRACT

The present invention provides an overhead travelling carriage with a hoist which suppresses transmission of vibration to an article during conveyance. A chuck mechanism 10 is provided in a hoist 7 to support the top of an article 4. A fall preventing mechanism 14 is provided to prevent the article 4 supported by the chuck mechanism 14 from falling. Movable members 18 are provided which can move in a horizontal direction so as to advance toward and retreat from the housed article 4. Each of the movable members 18 has an L-shaped side cross section that extends so as to cross the direction in which it advances and retreats. A horizontal portion 18*a* of the movable portion 18 acts as means for preventing the article from falling. Rubber dampers 19 are provided on that surface of a vertical portion 18*a* of the movable member which is closer to the article 4, so as to constitute members pressed against the article 4. Movable portions provided in the fall preventing mechanism 14 are composed of only rotationally movable portions.

6 Claims, 6 Drawing Sheets

MAXIMUM ADVANCED STATE

ADVANCING STATE

MAXIMUM RETREATED STATE

OVERHEAD TRAVELLING CARRIAGE

FIELD OF THE INVENTION

The present invention relates to an overhead travelling carriage which is provided with a hoist and which runs along a track installed above a floor surface, and in particular, to a mechanism that supports an article supported by the hoist and housed in the overhead travelling carriage.

BACKGROUND OF THE INVENTION

An overhead traveling carriage (hereinafter referred to as "carriage") has hitherto been known which is provided with a hoist and which runs along a track installed above a floor surface. The carriage is composed of a running section that allows the carriage to run along the track and an article supporting section in which the article is housed.

Such a carriage houses an article inside using a chuck mechanism provided in the hoist to support and raise a handle formed at the top of the article. The housed state of the article ends once the hoist has moved the chuck mechanism, supporting the article, up to the highest position. Then, in this state, the carriage starts to transfer the article.

In recent years, it has been desirable to increase the speed of a carriage that transfers wafers. However, when an attempt is made to cause the carriage to run at high speed, an article housed in the carriage may be oscillated around a chuck installed at the tip of a traction wire in a hoist. If the transferred article is a cassette that houses a large number of wafers, or the like and thus cannot sufficiently endure vibration, it is adversely affected by impact caused by oscillation as described previously.

It is thus an object of the present invention to provide an overhead travelling carriage with a hoist which suppresses transmission of vibration to an article during transfer.

SUMMARY OF THE INVENTION

The problems to be solved by the present invention are as described above. Means for solving these problems will be described below.

According to one aspect of the invention, there is provided an overhead traveling carriage which is provided with a hoist and which runs along a track installed above a floor surface, the overhead traveling carriage comprising a chuck mechanism provided in the hoist to support a top of an article and pressed members pressed against sides of the article.

According to another aspect, the pressed members are installed in front and rear portions, respectively, of the carriage.

According to a further aspect, the pressed members are installed in front and rear portions, respectively, of a casing installed in the carriage.

According to yet another aspect, the pressed members have an impact absorbing action.

According to a further aspect the pressed members are driven after the chuck mechanism has been elevated to the highest position.

In yet another aspect, the pressed members are arranged so as to hold a lower part of the article.

In a further aspect, the carriage is provided with a fall preventing mechanism that prevents the article supported by the chuck mechanism from falling, and the fall preventing mechanism is provided with the pressed members.

DETAILED DESCRIPTION OF THE PREFERRED EMBODIMENTS

Figure 1:
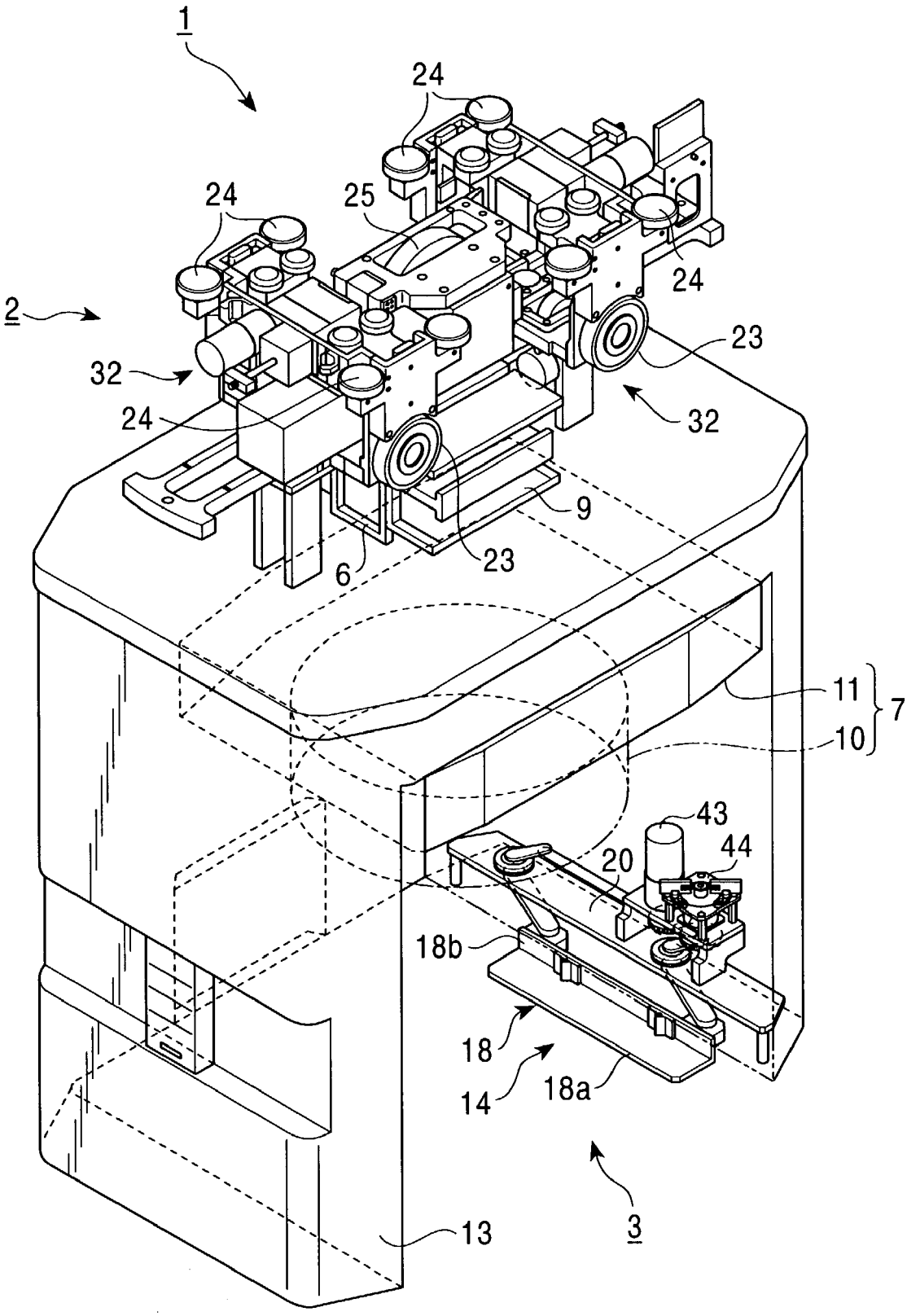
FIG. 1 is a perspective view showing an overhead travelling carriage.
Figure 2:
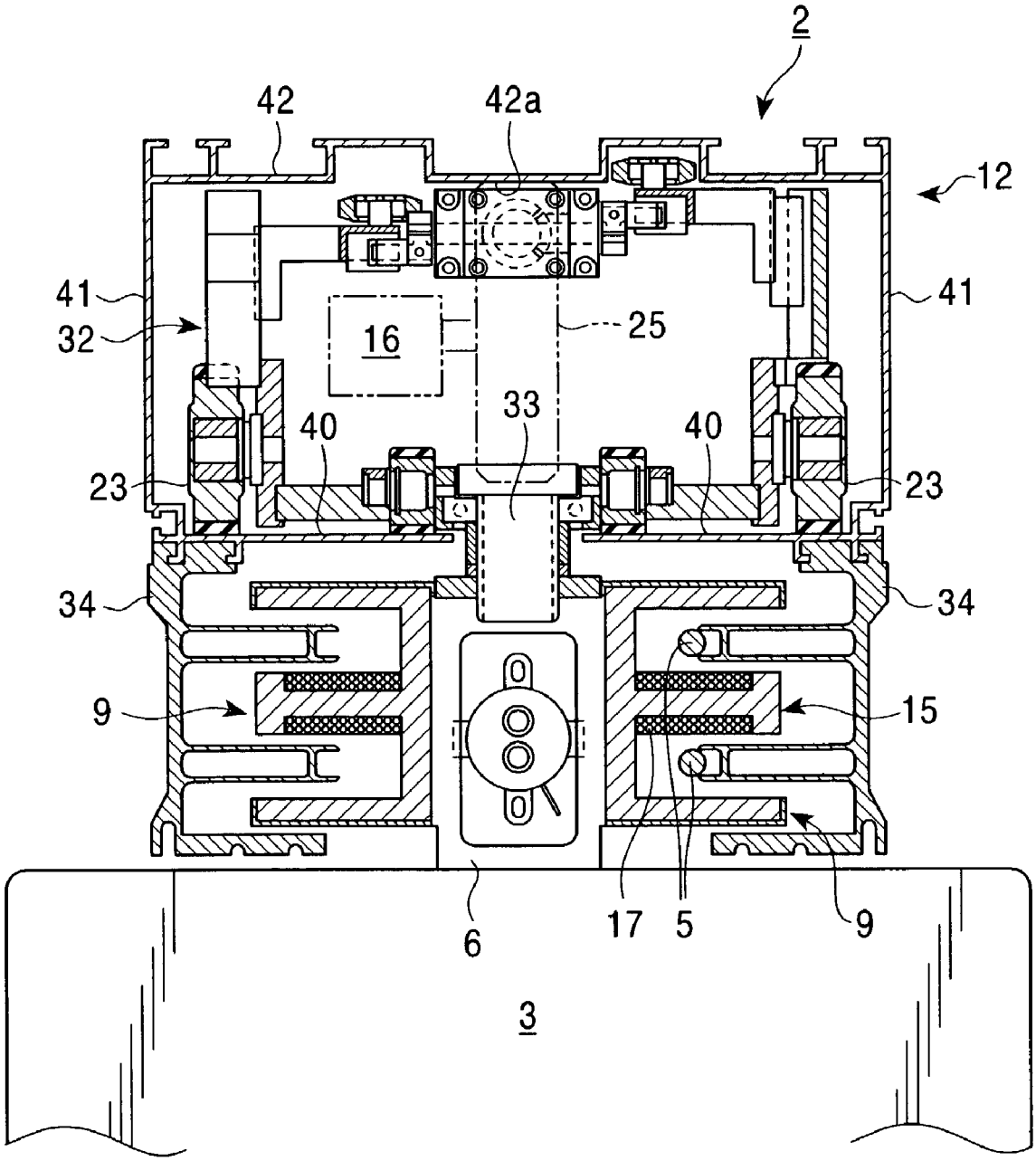
FIG. 2 is a front sectional view showing a track and the overhead travelling carriage.
Figure 3:
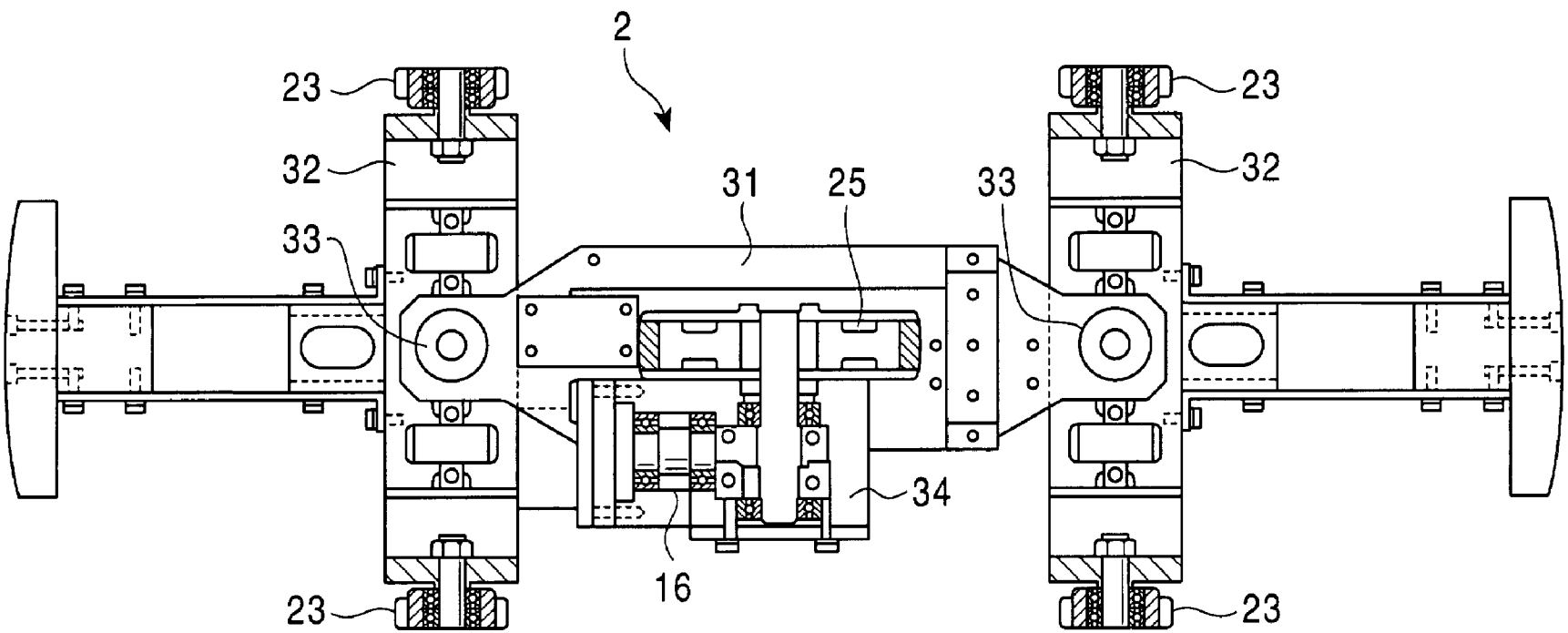
FIG. 3 is a top sectional view showing the overhead travelling carriage.

With reference to FIGS. 1 to 3, description will be given of a configuration of an overhead travelling carriage 1 as an embodiment of the present invention.

As shown in FIGS. 1 and 2, the carriage 1 is provided with a running section 2 in its upper part and an article supporting device 3 in its lower part. The running section 2 and the article supporting device 3 are joined together via a joint 6.

As shown in FIG. 3, the running section 2 is composed of a main frame 31 arranged in the center of the carriage 1 and wheel supporting sections 32, 32 located at the front and rear of the main frame 31. The wheel supporting sections 32, 32 and the main frame 31 are jointed together via rotationally movable shafts 33, 33 so that the wheel supporting sections 32, 32 can be rotationally moved relative to the main frame 31. The carriage 1 can run along a curved portion formed in a track 12.

Further, the article supporting device 3 is installed below the running section 2 and configured to mount a load on itself. The article supporting section 3 is supported by the running section 2 via the joint 6.

Further, a pair of pickup units 9, 9 are installed to the right and left of the joint 6 as means for feeding electricity to the carriage 1. Each of the pickup units 9, 9 is provided with an E-shaped core 15. Feeder lines 5, 5 provided below the track 12 can be inserted into corresponding openings in the core 15. Then, a pickup coil 17 provided in the core 15 utilizes electromagnetic induction to receive power from a magnetic field generated by an alternating current flowing through the feeder lines 5, 5. The feeder lines 5, 5 are supported on a feeder line holder 34 provided below the track 12.

The feeding means for the carriage 1 is not limited to this non-contact feeding method based on the core and the feeder lines.

The running section 2 is provided with a motor 16 as means for driving the carriage 1 as shown in FIGS. 2 and 3. The motor 16 is attached to the main frame 31. Further, a driving wheel 25 is installed coaxially with a motor shaft of the motor 16 so as to be driven and rotated by the motor 16.

As shown in FIGS. 1 to 3, the wheel supporting section 32 has an upward concave cross section as viewed from a running direction. Running wheels 23, 23 are arranged to the right and left, respectively, of lower part of the wheel supporting section 32 and each have a lateral axle. This axle is fixedly disposed on the wheel supporting section 32. The running wheels 23 are arranged to the left and right, respectively, of each of the front and rear wheel supporting sections 32. The running section 2 as a whole is provided with the four running wheels 23, arranged to the right and left of each of the front and rear wheel supporting sections 32. The running wheels 23 abut against running surfaces 40, 40 (described later) formed on the track 12 to support the carriage 1 on the track 12.

The track 12 is installed above the floor surface, and the carriage 1 is suspended from the track 12. The track 12 has a downward concave cross section as viewed from the direction of the track 12. The track 12 is composed of a base 42 extending in a horizontal direction and side walls 41, 41 extending from the respective ends of the base 42. Further, a horizontal portion is formed so as to extend from the lower end of each side wall 41, and has a top surface forming the running surface 40, against which the running wheels 23 abut. The bottom surface of laterally central portion of the base 42 forms a running surface 42*a* against which the driving wheel 25 abuts.

Further, as shown in FIG. 1 (not shown in FIG. 2), a lateral pair of guide wheels 24, 24 having vertical axles are provided at each of the right and left sides of top of the wheel supporting section 32. The lateral guide wheels 24, 24 allow the carriage 1 to run along the track 12 while substantially contacting with vertical portions (side walls of the track 12) 41, 41, described later, formed in the track 12 and without being shifted in a lateral direction.

The configuration of the article supporting device 3 will be described with reference to FIGS. 1 and 4.

The article supporting device 3 is provided with a hoist 7 and an arm 8 that can move the hoist 7 in a direction crossing the direction of the track 12. The hoist 7 is arranged below the arm 8. The hoist 7 is composed of a chuck mechanism 10 and a winch 11 acting as means for elevating and lowering the chuck mechanism 10. The chuck mechanism 10 is arranged below the winch 11. The tip of a wire (not shown in the drawings) is attached to the chuck mechanism 10. The chuck mechanism 10 can be elevated and lowered by winding and unwinding the wire.

A casing 13 surrounding the article supporting device 3 has openings in its bottom surface and right and left sides. The casing 13 allows the hoist 7 to be moved in the lateral direction and also allows the chuck mechanism 10 to be elevated and lowered.

A handle 4*a* is provided at the upper end of an article 4 and is gripped by the chuck mechanism 10 to support the article 4. The handle 4*a* is T-shaped as viewed from the horizontal direction.

On the other hand, the chuck mechanism 10 is configured to support a horizontally extending potion of the T-shaped handle 4*a*. The chuck mechanism 10 supports the handle 4*a* provided at the top of the article 4. Then, the winch 11 and the arm 7 drive the article 4 to house it in the casing 13. Once the winch 11 has moved the chuck mechanism 10, supporting the article 4, up to the highest position, the article 4 is assumed to be housed in the article housing device 3.

Figure 4:
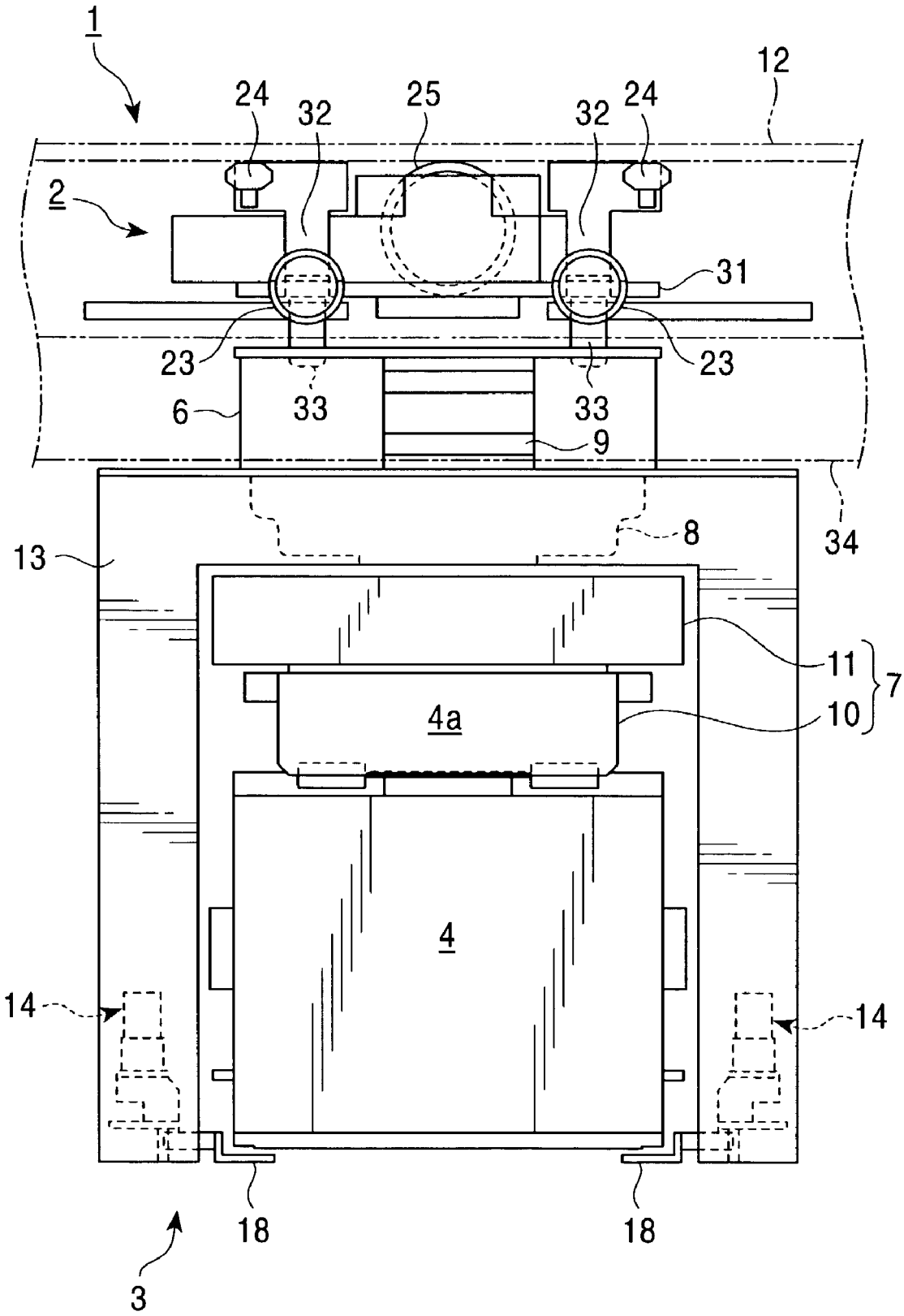
FIG. 4 is a side sectional view showing the overhead travelling carriage.
Figure 5:
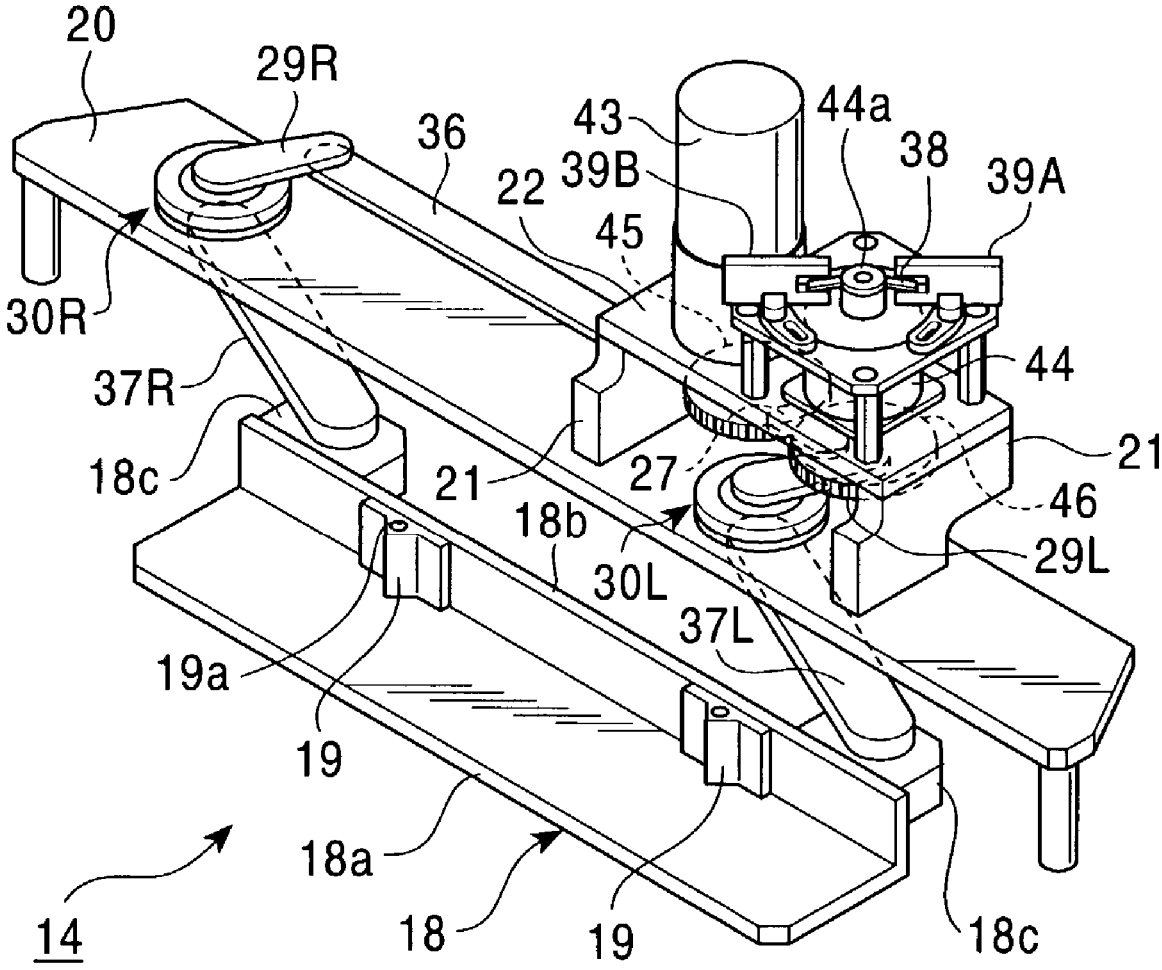
FIG. 5 is a perspective view showing a fall preventing mechanism.

With reference to FIGS. 1, 4, and 5, description will be given of a fall preventing mechanism 14 that prevents the article 4 housed in the article supporting device 3 from falling. As shown in FIGS. 1 and 4, the fall preventing mechanisms 14, 14 are provided in the front and rear, respectively, of lower part of the casing 13.

The fall preventing mechanism 14 prevents the article 4 supported by the chuck mechanism 10 from falling, and is configured to cause a movable member 18 to advance and retreat in the horizontal direction (forward and backward in the running direction of the carriage 1).

The movable member 18 has an L-shaped side cross section that extends so as to cross the direction in which it advances and retreats and the movable member 18 is composed of a horizontal portion 18*a* and a vertical portion 18*b*.

The horizontal portion 18*a* of the movable member 18 acts as means for preventing the article 4 housed in the article supporting device 3 from falling. The fall preventing mechanisms 14, 14, provided in the front and rear, respectively, of the casing 13, drive the movable members 18, 18 so as to move toward the interior of the casing 13 (this driving operation will be described later). Then, the horizontal portions 18*a*, 18*a* of the movable members 18, 18 are located below the front and rear ends of the housed article 4.

Thus, even if the article 4 slips off the chuck mechanism 10, the horizontal portions 18*a*, 18*a*, as the fall preventing means, can prevent the article 4 from falling from the article supporting device 3.

The vertical portion 18*b* of the movable member 18 is provided with a pair of rubber dampers 19 on a side facing the housed article 4, the rubber dampers constituting elastic members. The rubber dampers 19 are configured to operate as members pressed against the housed article 4. The rubber dampers 19 are formed so as to be angular and to project toward the article 4 (the interior of the casing 13) as shown in FIG. 5. Each of the rubber dampers 19 also has a vertical cavity portion 19*a* in the angular portion. This formation serves to enhance an impact absorbing action.

The fall preventing mechanisms 14, 14, provided in the front and rear of the casing 13, drive the movable members 18, 18 toward the interior of the casing 13 (this driving operation will be described later). Then, the vertical portions 18*b*, 18*b* of both movable members 18, 18 approach the housed article 4, and the pair or rubber dampers 19, 19, provided on each vertical portion 18*b*, abut against sides of the article 4.

Thus, the pair of dampers 19, 19 are pressed against the lower end of the article 4 from its front and rear, thus allowing the article 4 to be held stably by the fall preventing mechanisms 14, 14.

If the rubber dampers 19, 19 are not pressed against the article 4, when the carriage 1 runs with the article 4 housed in the casing 13, vibration in the running device 2 is transmitted to the article supporting device 3. Consequently, the article 4 is oscillated forward and backward around that point of the handle 4*a* of the article 4 which is supported by the chuck mechanism 10.

However, according to the present invention, the pressed members composed of the rubber dampers 19 are pressed against the sides of the article 4 from its front and rear to enable the article 4 to be held stably. This prevents the article 4 from being oscillated forward and backward around the point supported by the chuck mechanism 10 even if vibration is transmitted to the article supporting device 3 owing to running of the carriage 1 or the like.

The fall preventing mechanism 14 is provided with the rubber dampers 19 which are the members being pressed against the article 4. The fall preventing mechanism 14 can drive both the means for preventing the housed article 4 from falling and the rubber dampers 19, which are the members pressed against the article 4. That is, the fall preventing mechanism 14 according to this embodiment acts as both the fall preventing mechanism, which drives the fall preventing means, and the pressed mechanism, which drives the pressed members.

Since the fall preventing mechanism 14 according to this embodiment is configured as described above, the article supporting device 3 is provided with the fall preventing mechanism, which prevents the article 4 supported by the chuck mechanism 10 from falling, and the pressed members, which are abutted against the sides of the article 4.

This prevents the article 4 from slipping off the chuck mechanism 10 and prevents the article 4 from being oscillated even if the article supporting device 3 (carriage 1) is vibrated. In particular, the article 4 is prevented from being oscillated even if it is a cassette that houses wafers, or the like, i.e. it is composed of a member that cannot sufficiently endure vibration. Consequently, the carriage 1 can perform smooth conveying operations at high speed.

Further, in the above description, the carriage 1 is provided with the movable members 18 that can advance and retreat in the horizontal direction relative to the housed article 4. Furthermore, the movable member 18 acts as both the fall preventing means, composed of the horizontal portion 18*a*, and the pressed members, composed of the rubber dampers 19. Accordingly, the fall preventing mechanism 14 according to this embodiment acts as both the means for preventing the housed article 4 from falling and the members pressed against the housed article 4, as described previously.

Thus, the fall preventing mechanism 14, which prevents the article 4 from falling, can also prevent the article 4 from being oscillated. This helps reduce the number of members required for the carriage 1.

In this embodiment, the fall preventing mechanism 14 acts as both pressed members and fall preventing means. However, the pressed members and the fall preventing mechanism 14 may be provided separately so as to operate independently. On the other hand, if fall preventing measures other than the overhead travelling carriage are taken, such as a fall preventing net installed under the track, no fall preventing mechanisms need be provided in the overhead travelling carriage. In this case, the article 4 can be more efficiently prevented from being oscillated by abutting the pressed members against the lower sides of the article 4.

Now, with reference to FIGS. 1, 4, 5, and 6, description will be given of a drive transmitting mechanism that drives the movable member 18, provided in the fall preventing mechanism 14.

As shown in FIG. 1, a mounting plate 20 is a mounting member attached to the casing 13 for the fall preventing mechanism 14. A drive source and the drive transmitting mechanism are provided on the mounting plate 20 to drive the movable member 18. As shown in FIG. 5, struts 21, 21 are fixedly disposed on the mounting plate 20, and a support plate 22 is fixedly disposed on the struts 21, 21. A motor 43 is provided on the support plate 22 as the drive source, and a brake 44 is also provided on the support plate 22.

Figure 6C:
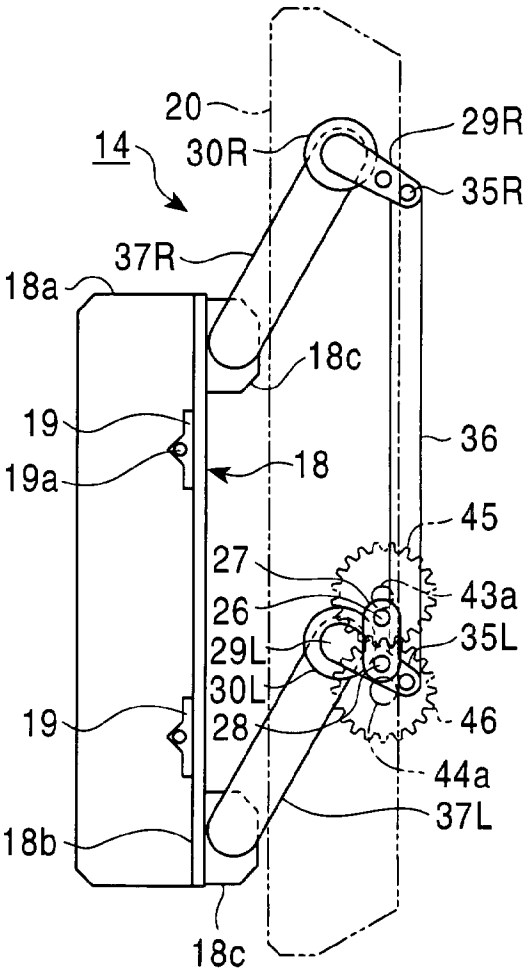
FIG. 6 is a plan view showing how the fall preventing mechanism is driven.
Figure 6B:
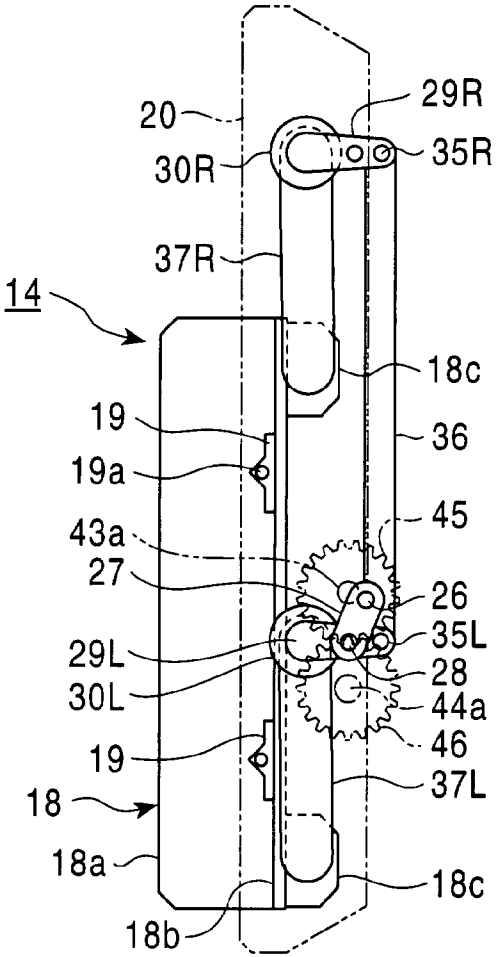

As shown in FIGS. 5 and 6, the drive transmitting mechanism is configured to operate as a crank mechanism that converts rotational driving of a motor shaft 43*a* of the motor 43 into forward and backward movement of the movable member 18.

A through-hole is formed in the support plate 22 coaxially with the motor shaft 43*a* of the motor 43. Through this through-hole, the motor shaft 43*a* extends downward from the support plate 22. A gear 45 is fixedly disposed at the lower end of the motor shaft 43*a*. A rotationally movable shaft 26 is provided on the bottom surface of the gear 45 and radially outside the gear 45 relative to the motor shaft 43*a*. That is, the rotationally movable shaft 26 is driven by the motor 43 to rotate around the motor shaft 43*a*. In this case, the gear 45 is configured to operate as a crank of the crank mechanism.

A brake shaft 44*a* extends from the brake 44, provided at the side of the motor 43. A gear 46 is fixedly disposed at the lower end of the brake 44*a* so as to mesh with the gear 45. In this configuration, when the motor shaft 43 is rotated, the brake shaft 44*a* rotates so as to follow the rotation of the motor shaft 43 through the meshing of the gears 45, 46 with each other. The brake 44 can brake the brake shaft 44*a* to stop the drive transmitting mechanism, provided in the fall preventing mechanism 14, from performing a driving operation.

Further, the brake 44 is provided with position detecting means for detecting an advanced and retreated positions of the movable member 18.

The upper end of the brake shaft 44*a* is located above the brake 44 and provided with a detected member 38 extending in the radial direction of the brake shaft 44*a*. Further, at the upper end of the brake shaft 44*a*, position detecting sensors 39A, 39B are disposed radially outside the brake 44*a*. The detected member 38 and the position detecting sensors 39A, 39B compose position detecting means for the movable member 18.

Figure 6A:
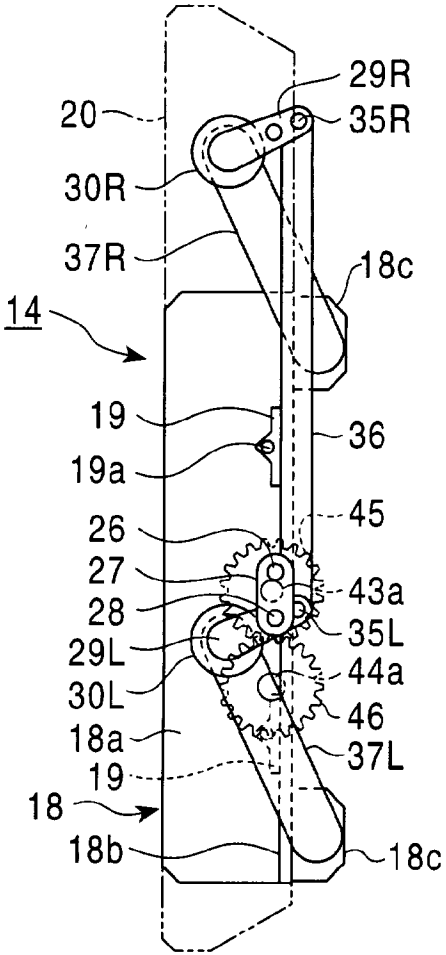

The position detecting sensors 39A, 39B are photosensors that detect that an optical path is interrupted, e.g. transmission photoelectric sensors. That tip of each of the position detecting sensors 39A, 39B which is closer to the brake shaft 44*a* is formed to have a concave portion through which the detected member 38 passes as the brake shaft 44*a* is rotated. When the detected member 38 passes through the brake shaft 44*a*-side tip of the sensor 39A or 39B, the optical path formed inside the concave portion in the tip of this sensor 39A or 39B is interrupted to allow the sensor 39A or 39B to detect the detected member 38. The position detecting sensors 39A, 39B are adapted to detect the maximum retreated and advanced positions of the movable member 18. At the maximum retreated position of the movable member 18, the movable member 18 retreats from the article 4 by the maximum distance and is housed under the mounting plate 20 as shown in FIG. 6A. At the maximum advanced position of the movable member 18, the movable member 18 advances toward the article 4 by the maximum distance to prevent the article 4 from falling and to be pressed against the article 4 as shown in FIG. 6C.

The advanced and retreated positions of the movable member 18 correspond to the rotary position of the brake shaft 44*a* (the rotary position of the motor shaft 43*a*). Accordingly, this correspondence determines the positions at which the sensors 39A, 39B, which detect the maximum retreated and advanced positions of the movable member 18, are disposed.

The lower end of the rotationally movable shaft 26 is provided at one end of a first link 27 so that the movable shaft 26 is rotationally movable. The other end of the first link 27 is provided with a rotationally movable shaft 28 provided in the center of a second link 29L so as to be rotationally movable.

The second links 29L, 29R are disposed on the left and right of the movable member 18 relative to the direction in which the movable member 18 advances and retreats and the second links 29L, 29R are configured to operate as parallel links as described below.

At both ends of the second links 29L, 29R, fulcrum shafts 30L, 30R and rotationally movable shafts 35L, 35R are provide respectively. The fulcrum shaft 30 is provided at one end (closer to the article 4) of the second link 29 and is disposed on the mounting plate 20 so as to be rotationally movable. The rotationally movable shafts 35L, 35R are joined together via a joint link 36. The rotationally movable shafts 35L, 35R are disposed at the respective ends of the joint link 36 so as to be rotationally movable.

As described above, the fulcrum shafts 30L, 30R are disposed on the mounting plate 20, and their positions (in a horizontal plane) remain unchanged. On the other hand, the rotationally movable shafts 26, 28, 35L, 35R have their positions in the horizontal plane varied by rotation of the motor shaft 43*a*. Accordingly, when the motor 43 drives and rotates the second link 29L around the fulcrum shaft 30 via rotation of the gear 45 and movement of the first link 27 and others, the second link 29R is rotated parallel with the second link 29L.

The fulcrum shafts 30L, 30R are fixedly disposed on the second links 29L, 29R, respectively. The mounting plate 20 is provided not only with the fulcrum shafts 30L, 30R but also with through-holes through which the fulcrum shafts 30L, 30R extend downward from the mounting plate 20. Further, lower ends of arms 37L, 37R are fixedly disposed at the lower ends of the fulcrum shafts 30L, 30R, respectively. That is, the second link 29L and the arm 37L are fixed to each other and rotate around the fulcrum shaft 30L. The second link 29R and the arm 37R are also fixed to each other and rotate around the fulcrum shaft 30R.

The arms 37L, 37R are disposed on the movable member 18 at those ends of the arms 37L, 37R which are opposite to the fulcrum shafts 30L, 30R, respectively, so that the arms 37L, 37R are rotationally movable.

More specifically, mounting portions 18*c*, 18*c* are fixedly disposed on that surface of the vertical portion 18*b* of the movable member 18 which is further from the article 4, and on the right and left, respectively, of the movable member 18 relative to the advancing and retreating direction. The ends (opposite to the fulcrum shafts 30L, 30R) of the arms 37L, 37R are disposed on the respective mounting portions 18*c*, 18*c* so as to be rotationally movable.

When the second links 29L, 29R, parallel links, rotate around the fulcrum shafts 30L, 30R, respectively, the arms 27L, 27R, fixed to the second links 29L, 29R, respectively, are rotated around the fulcrum shafts 30L, 30R, respectively, to move the movable member 18 so as to advance toward or retreat from the article 4.

The mounting plate 20 is provided with the drive transmitting mechanism, which enables the movable member 18 to advance toward and retreat from the article 4, as described above. The drive transmitting mechanism is the crank mechanism that converts rotational movement of the motor shaft 43*a* into forward and backward movement of the movable member 18 as described previously. That is, the drive transmitting mechanism, provided in the fall preventing mechanism 14, is composed of only the rotationally movable portions. In addition, the fall preventing mechanism 18 according to this embodiment does not only prevent the article 4 from falling but is also pressed against the article 4 as described previously.

Thus, the present invention significantly reduces the amount of dust from the drive transmitting mechanism compared to relative-position-varying movable portions in which an electric cylinder or the like is used to slide and move relevant members.

Further, the movable member 18 is advanced substantially linearly by the previously described crank mechanism. This prevents the movable member 18 from rubbing against the article to suppress the occurrence of dust. Therefore, the fall preventing mechanism 14 according to the present invention can be used in workshops such as clean rooms which are likely to be affected by dust.

According to one aspect of the invention, there is provided an overhead traveling carriage which is provided with a hoist and which runs along a track installed above a floor surface, the overhead traveling carriage comprising a chuck mechanism provided in the hoist to support a top of an article and pressed members that are pressed against sides of the article. Consequently, the article is prevented from being oscillated even if the carriage is vibrated. In particular, the article is prevented from being oscillated even if it is a cassette that houses wafers, or the like, i.e. it is composed of a member that cannot sufficiently endure vibration. Consequently, the carriage can perform smooth conveying operations.

According to another aspect, the pressed members are installed in front and rear portions, respectively, of the carriage. This effectively prevents the oscillation of the article associated with acceleration or deceleration.

According to a further aspect, the pressed members are installed in front and rear portions, respectively, of a casing installed in the carriage. This effectively prevents the oscillation of the article as well as the hoist associated with acceleration or deceleration.

According to yet another aspect, the pressed members have an impact absorbing action. Consequently, the vibration of the article can be effectively absorbed during running and when the pressed members abut against the article.

According to a further aspect, the pressed members are driven after the chuck mechanism has been elevated to the highest position. Consequently, the oscillation of the article can be suppressed while reliably protecting the article using the casing.

In yet a further aspect, the pressed members are arranged so as to hold a lower part of the article. Therefore, the article can be supported stably and firmly.

In a further aspect, the carriage is provided with a fall preventing mechanism that prevents the article supported by the chuck mechanism from falling, and the fall preventing mechanism is provided with the pressed members. Therefore, the article is prevented from falling from the carriage even if the track is not provided with any fall preventing mechanisms. Further, the pressed members are provided in the fall preventing mechanism. This simultaneously prevents falling and oscillation of the article, and allows the lower part of the article to be held by the pressed members. Therefore, the article can be supported stably and firmly.

The invention claimed is:

1. An apparatus for transporting an article, said apparatus comprising:

an overhead traveling carriage and an overhead track on which said traveling carriage moves, said traveling carriage including a hoist which raises or lowers said article, a casing into which said article is raised or lowered, and a fall preventing mechanism which advances and retreats in a horizontal plane, wherein said hoist comprises a winch and a chuck mechanism, and said fall preventing mechanism includes pressed members to press against said article, said fall preventing mechanism being retractable into said casing, wherein when an upper end of said article is chucked by the chuck mechanism, opposing sides of said article are pressed and held stably by said pressed members.

2. The apparatus of claim 1, wherein said pressed members are located at a front and a rear of said carriage, wherein said pressed members press the article in the direction in which the traveling carriage runs forward and backward.

3. The apparatus of claim 2, further comprising shock-absorbing dampers attached to said pressed members.

4. The apparatus of claim 3, further comprising a means for engaging an article by pressing said pressed members against said article.

5. The apparatus of claim 4, wherein said means for engaging said article is driven when said chuck mechanism reaches its highest point.

6. The apparatus of claim 1, wherein said fall preventing mechanism includes a vertical portion and a horizontal portion extending from the vertical portion, wherein said pressed members extend from the vertical portion to press against said article.

* * * * *